US007513378B2

(12) United States Patent
Mori et al.

(10) Patent No.: US 7,513,378 B2
(45) Date of Patent: Apr. 7, 2009

(54) EXTENDABLE CONTAINER

(75) Inventors: Akihide Mori, 8-22, Oimazato 1 Chome, Higashinari-Ku, Osaka-Shi, Osaka 537-0012 (JP); Shin Sakai, Ashiya (JP)

(73) Assignee: Akihide Mori (JP)

( * ) Notice: Subject to any disclaimer, the term of this patent is extended or adjusted under 35 U.S.C. 154(b) by 531 days.

(21) Appl. No.: 10/540,608

(22) PCT Filed: Jun. 13, 2003

(86) PCT No.: PCT/JP03/07588

§ 371 (c)(1),
(2), (4) Date: Jun. 27, 2005

(87) PCT Pub. No.: WO2004/110879

PCT Pub. Date: Dec. 23, 2004

(65) Prior Publication Data

US 2006/0081555 A1 Apr. 20, 2006

(51) Int. Cl.
*B65D 1/02* (2006.01)

(52) U.S. Cl. ..... 215/381; 215/12.1; 215/900; 220/666

(58) Field of Classification Search ..... 215/381, 215/365, 900, 12.1; 220/666, 669, 670, 672, 220/675; 40/310
See application file for complete search history.

(56) References Cited

U.S. PATENT DOCUMENTS 3,918,603 A * 11/1975 Hatada ..... 220/667
4,157,103 A * 6/1979 La Fleur ..... 141/98
4,456,134 A * 6/1984 Cooper ..... 215/341
4,790,361 A * 12/1988 Jones et al. ..... 220/666
5,299,700 A * 4/1994 Beniacar ..... 215/12.1
5,370,250 A * 12/1994 Gilbert ..... 222/1
6,354,458 B1 * 3/2002 Policappelli ..... 220/674
6,662,964 B2 * 12/2003 Higuchi ..... 220/667

FOREIGN PATENT DOCUMENTS

JP 07219439 A * 8/1995
JP 08054829 A * 2/1996
JP 08-217046 8/1996
JP 2001-039443 2/2001

* cited by examiner

*Primary Examiner*—Sue A Weaver
(74) *Attorney, Agent, or Firm*—Thompson Hine LLP

(57) ABSTRACT

An extendable container including a container body and a sheet, the container body having a bottom part, a bellows barrel part extendable in a height direction, and a top part having an openable cover, the sheet being wrapped around the outer circumference of the container body to secure the container body, wherein the bellows barrel part includes ring portions, each having a predetermined width and trough portions, the ring portions including projections arranged thereon, and wherein the sheet includes locking holes at positions in alignment with the projections of the ring portion such that the locking holes receive the respective projections when the sheet is wrapped around the bellows barrel part.

3 Claims, 4 Drawing Sheets

EXTENDABLE CONTAINER

TECHNICAL FIELD

The present invention relates to containers having a bellows barrel body extendable in the longitudinal direction thereof and, in particular, to a container that maintains a predetermined longitudinal length with a sheet wrapped around the bellows barrel body during use while contracting in the longitudinal length for a smaller volume with the sheet removed during transportation or at disposal.

BACKGROUND ART

Plastic bottles, such as polyethylene terephthalate (hereinafter named "PET") bottles, are used in a large quantity as a container for holding refreshing drinks, seasoners, or the like. These containers have a constant volume regardless of whether the containers are empty or filled with a drink, and need a big space for storage or transportation. Since the efficiency of storage and transportation is not good, storing or transporting the containers is costly. The containers are bulky at disposal, and a disposal process is not only time consuming, but also pollutes the environment.

Japanese Open Gazette No. 8-72844 and Japanese Open Gazette No. 2002-326620 disclose containers having a bellows barrel body. Such contains are contracted during transportation or at disposal. However, the container, if filled with content, is unable to maintain the container volume thereof because the bellows barrel body is extendable. For example, if the container is lifted, the barrel portion is extended by the weight of the container and the content thereof. It is thus difficult to maintain the container to a fixed shape. The barrel portion is tilted or bent, and the container is unable to stand upright alone.

Japanese Open Gazette No. 9-156625 proposes a PET bottle. A reinforcement assembly is attached to the PET bottle to prevent a bellows barrel portion thereof from being bent.

The reinforcement assembly includes an upper ring member, a lower ring member, and a plurality of bands or strings, having no fixed shape. The upper and lower ring members are received in an upper groove and a lower groove arranged on the barrel portion with the bands extended between the upper and lower rings. The container is thus complex in structure with the grooves having a particular shape. It takes time to fit the ring members. The container has room for improvements.

The present invention has been developed to overcome the above-referenced drawback. It is an object of the present invention to provide a container that has a bellows barrel portion, maintains a fixed shape, and is reduced in size with the longitudinal length thereof contracted during transportation or storage, or at disposal.

DISCLOSURE OF INVENTION

The present invention provides an extendable container including a container body including a bottom part, a bellows barrel part extendable in a height direction thereof, and a top part having an openable cover, and a sheet, the sheet wrapped around the outer circumference of the container body to secure the container body. The bellows barrel part includes ring portions, each having a predetermined width and trough portions. The ring portion includes projections arranged thereon at regular intervals, and the sheet includes locking holes at positions in alignment with the projections of the ring portion so that the locking holes receive the respective projections with the sheet wrapped around the bellows barrel part. The sheet thus helps the extendable container maintain the height thereof, and stand upright alone without being tilted or bent. The container is folded in the height direction for smaller size before and after use. Space required to store and transport the containers is reduced. As big storage space is not required, costs involved in storage and transportation are substantially reduced. With the projections arranged on at least three ring portions, including a top ring portion, an intermediate ring portion, and a bottom ring portion, the container body is fixed.

Instead of or in addition to the projections, a peelable adhesive agent may be applied to a rear surface of the sheet to secure the sheet onto the bellows barrel part of the container body. The use of the peelable adhesive agent also reinforces the container body to maintain the height thereof. The container is thus free from tilting and bending.

If the sheet is peeled, the container body can be folded in the height direction. The size of the container is thus reduced. With the container reduced in size, costs involved in storage, transportation, and disposal are substantially reduced. The adhesive agent may be applied in a plurality of bands, on the rear surface of the sheet, extending in the height direction of the sheet or the circular direction of the sheet.

PREFERABLE EMBODIMENTS OF THE INVENTION

Figure 1:
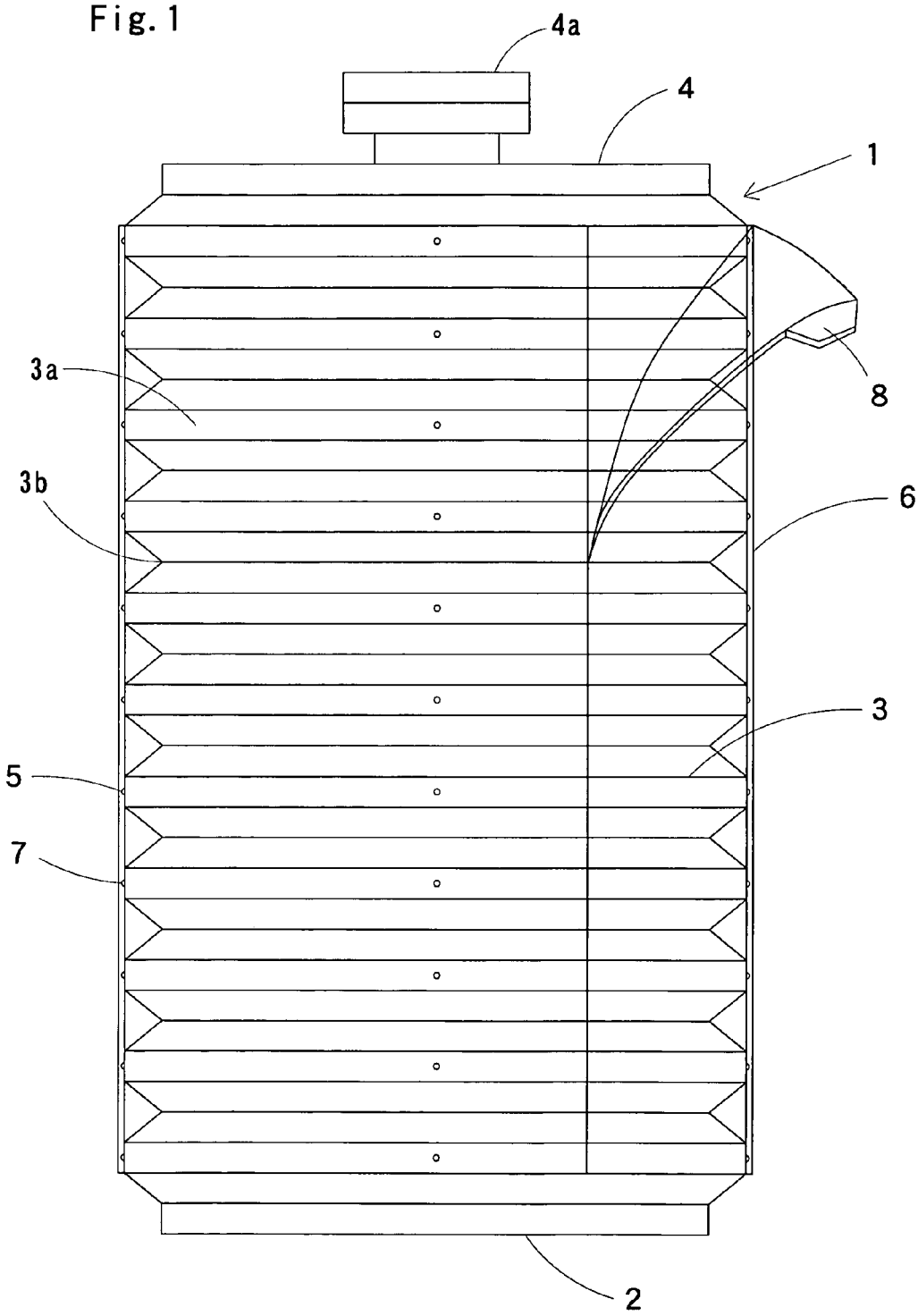
FIG. 1 is a front view of an extendable container of the present invention.

An extendable container of one preferred embodiment of the present invention is described below with reference to the drawings. FIG. 1 is a front view of an extendable container of the present invention in the use state thereof, and FIG. 2 is a front view of the extendable container in the folded state thereof in the height direction with a sheet peeled off.

Figure 2:
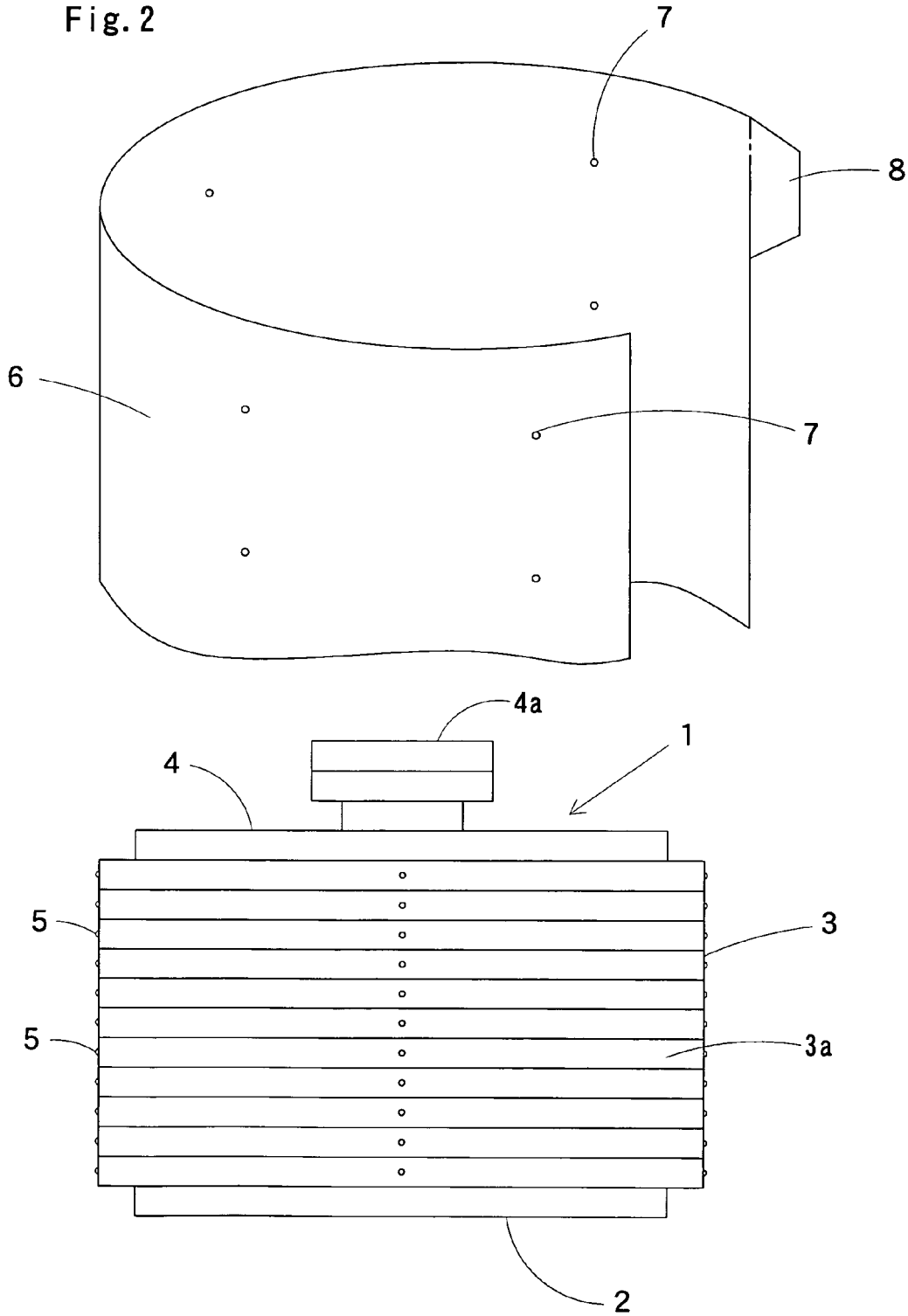
FIG. 2 is a front view of the extendable container in the folded state thereof with a sheet peeled off.

Referring to FIGS. 1 and 2, a cylindrical container body 1 includes a bottom part 2, a barrel part 3 having a bellows structure extendable in the height direction thereof, and a top part 4 having an openable cover 4*a*. The bellows structure, typically composed of peaks and troughs alternating with each other, is foldable. In accordance with the present embodiment, the peak is formed of a ring portion having a predetermined width. The ring portion 3*a* and the trough portion 3*b* periodically alternate with each other. Projections 5 . . . 5 . . . are arranged at regular intervals along each ring portion 3*a*. If the container is folded in the height direction thereof, the trough portions 3*b* are folded as shown in FIG. 2. Only the ring portions 3*a* are exposed, and the entire container is thus reduced, thereby requiring less space.

A sheet 6 is wrapped around the barrel part 3 of the container body 1. The rear surface of the sheet 6 is coated with an adhesive agent. The sheet 6 is glued to the bellows structure of the ring portions 3*a* of the container body 1. With the sheet 6 glued to the container body 1, the ring portions 3*a* are reinforced. The barrel part 3, free from tilting and bending, stands upright alone. The sheet 6 includes locking holes 7 . . . 7 . . . at positions in alignment with the projections 5 . . . 5 . . . arranged on the ring portions 3*a*. With the projections 5 . . .

5 . . . respectively received in the locking holes 7 . . . 7 . . . , the ring portions 3*a* are secured, and the entire container is reinforced. Locking notches may be arranged instead of the locking holes 7. Regardless of through-holes or notches, any means is acceptable as long as the means locks the projections 5. The entire container firmly reinforced in this way sufficiently withstands pressure even if the container is filled with an internally pressurized drink such as a carbonated drink.

The adhesive agent applied on the rear surface of the sheet 6 is preferably a low-sticking strength one. The use of the low-sticking strength adhesive agent allows the sheet 6 to be peeled off after use to fold the container in the height direction thereof. To assist a user to peel the sheet 6 off, a lug 8 may be extended from the top edge of the sheet 6. The user peels the sheet 6 by pulling the lug 8. The sheet 6 may be glued on the container body so that the edges thereof join each other. It is perfectly acceptable the edge portions of the sheet 6 partially overlap each other when the fixing sheet 6 is wrapped around the container.

Intervals between the locking holes 7 in the sheet 6 in the height direction are optionally set. Since the container body 1 is extendable in the height direction thereof, the available capacity of the container is varied by setting the intervals between the locking holes 7 to a predetermined length. If the vertical interval between the locking holes is set to be small, the height of the container becomes smaller. If the vertical interval between the locking holes is set to be large, the height of the container becomes larger. The containers of the same type can be arranged as containers different in capacity.

The materials of the container body 1 and the sheet 6 are not limited to any particular ones. Depending on applications, the materials of the container body 1 may be selected from PET, polyethylene, and polypropylene.

The method of using the extendable container thus constructed is described below.

The unused container body 1 is stored in the folded state as shown in FIG. 2. The sheet 6 is stored in its flat state. Both the container body 1 and the sheet 6 in those states require no large storage space. The container prior to the filling thereof with content such as a drink is small enough in capacity. Space required for storage in a storehouse or for transportation by truck is small. Large quantities of containers are easily stored or transported. Costs involved in storage and transportation are substantially reduced.

When the container body 1 is filled with contents, the container body 1 is expanded and the sheet 6 is wrapped around the container body 1 to stand upright alone. As previously discussed, the capacity of the container body 1 is determined by the intervals between the locking holes 7 of the sheet 6 in the height direction. Like a conventional container, the container is filled with a content using a conventional facility. The container body filled with the drink is shipped and sold as a product.

When the drink is consumed to the middle amount thereof, the sheet 6 may be peeled off and the container is partially folded to a level of the remaining content. In this way, the amount of air is minimized in the container and effervescence of any carbonated drink is controlled.

When the drink is fully consumed, the container body 1 is folded and is then disposed together with the sheet 6. The volume of the disposed containers as a trash is substantially reduced. Costs involved in storage and transportation are greatly reduced.

The above-referenced embodiment employs two means for wrapping the sheet 6 around the container body, namely, the adhesive agent applied on the inner surface of the sheet 6 and the engagement of the projections 5 on the ring portion 3*a* and the locking holes 7. One of the two means is sufficient to fix the height of the container. More specifically, the height of the container is sufficiently fixed only by wrapping the sheet 6 with the adhesive agent applied on the inner surface thereof around the outer circumference of the container body 1 expanded to a desired height. The height of the container is also fixed only by engaging the locking holes 7 with the projections 5 arranged on the ring portion 3*a* of the container body.

It is not necessary to apply the adhesive agent on the entire rear surface of the sheet 6. The adhesive agent may be applied in a plurality of bands in a small width extending in the height direction or in a plurality of bands in a small width extending in the circular direction in alignment with the ring portions. The height of the container is thus fixed. When the projections 5 on the ring portions 3*a* of the container body 1 are engaged with the holes of the sheet 6, it is not necessary to arrange the projections 5 on all ring portions 3*a*. The height of the container is fixed if the projections 5 are arranged on at least three ring portions 3*a*, namely, a top ring portion 3*a*, an intermediate ring portion 3*a*, and a bottom ring portion 3*a*.

If the sheet 6 is wrapped around and fixed to the container body 1 with the projections 5 engaged with the locking holes 7, the vertically flat ring portion 3*a* is not required in the container body 1. Alternatively, the bellows structure may be formed of peaks and troughs, with one peak alternating with another trough, and the projections are arranged on the peaks. The sheet is wrapped around and fixed to the container using the projections on the peaks.

Figure 3:
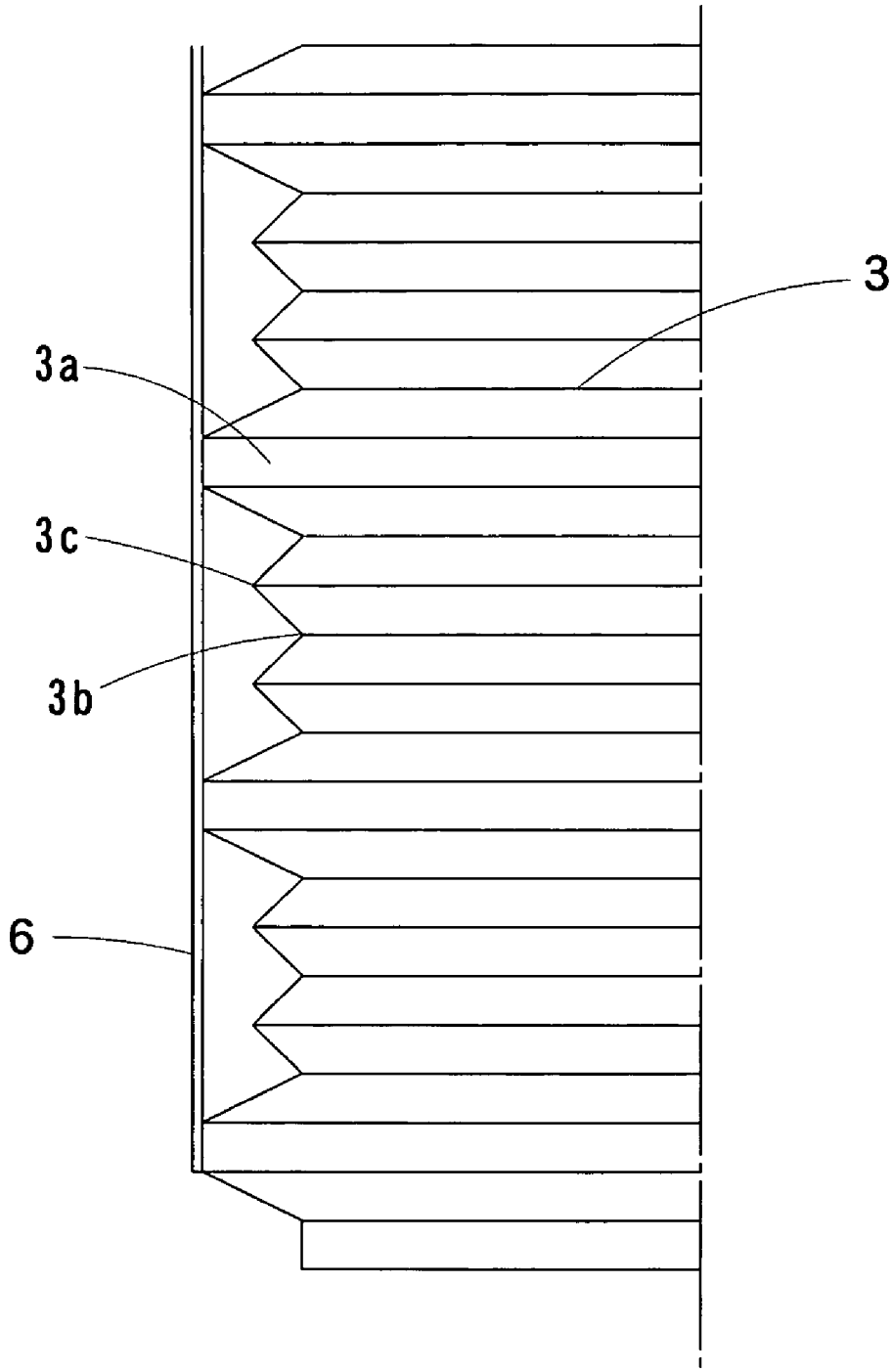
FIG. 3 partially illustrates a bellows barrel structure of the extendable container.

The bellows structure of the barrel part 3 is not limited to the one with the ring portion 3*a* alternating with the trough portion 3*b*. As shown in FIG. 3, a peak 3*c* and a trough 3*b* are alternated between ring portions 3*a* having a vertically flat surface. In this arrangement, the container body is extendable and with the sheet wrapped around the container body, the purpose of the present invention is achieved.

The sheet 6 may be transparent or opaque. Optionally, a trade name, a pattern, and specifications may be printed on the front surface of the sheet 6. The commercial value of the container may be enhanced by attaching a variety of designs and displays on the surface of the sheet.

Figure 4:
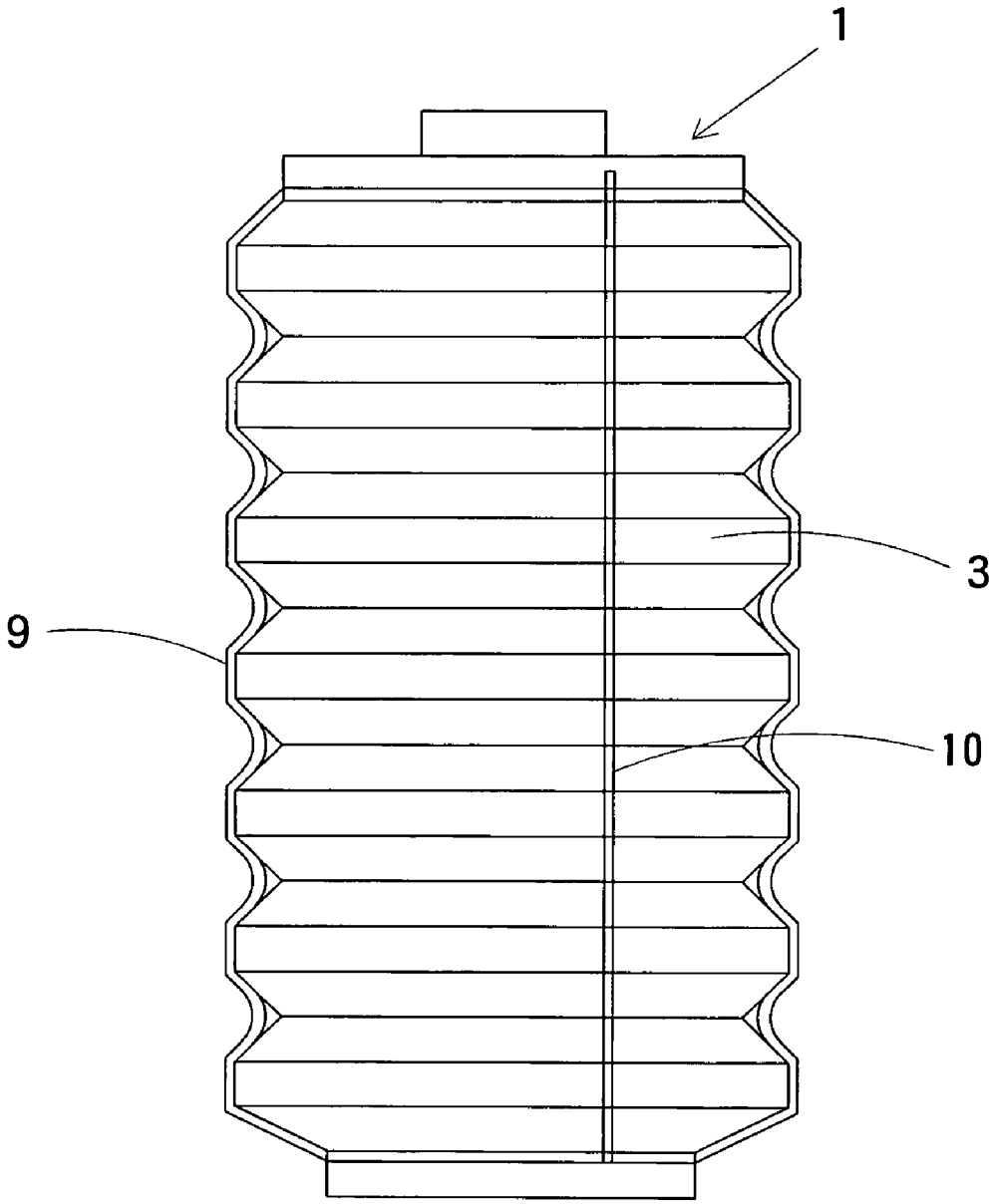
FIG. 4 is a front view of the extendable container with a shrink film used instead of the sheet.

The sheet is preferably wrapped using the above-referenced means. As shown in FIG. 4, the barrel part 3 may be simply covered with a cylindrical shrink-film 9 and the film 9 is then heated for shrinking to fix the barrel part 3. The extendable barrel part 3 is thus temporarily fixed. In this case, a string 10 or a perforated line may be arranged in the height direction of the sheet to help the user tear the sheet open from the container body.

INDUSTRIAL APPLICABILITY

As described above, the extendable container of the present invention includes the barrel part of the container body having an extendable bellows structure. During storage prior to use, or during transportation, and at disposal after use, the container can be folded. The space required by the container is reduced. The container requires small space for storage and transportation, and substantial cost reduction is achieved. Since the container is disposed in the folded state thereof, the bulk of disposed containers is significantly reduced.

During use, the sheet is wrapped around and fixed to the container body. The container body, free from tilting and deformation, stands upright alone. By setting the locking holes at proper positions in the sheet, the capacity of the container is variably set.

Since the container body standing upright alone with the sheet wrapped around the container is not different in posture from the conventional container, the container is filled with a content using an existing facility.

The invention claimed is:

1. An extendable container comprising a container body including a bottom part, a bellows barrel part extendable in a height direction, and a top part having an openable cover, and a sheet, said sheet wrapped around an outer circumference of the container body to secure the container body, wherein the bellows barrel part includes ring portions, each having a predetermined width and trough portions, the ring portions including projections arranged thereon, and wherein the sheet includes locking holes at positions in alignment with the projections of the ring portions so that the locking holes receive the respective projections when the sheet is wrapped around the bellows barrel part.

2. The extendable container according to claim 1, wherein the bellows barrel part comprises the ring portions, each having the predetermined width and the trough portions, and wherein the sheet is secured to the bellows barrel part by applying a peelable adhesive onto a rear surface of the sheet and then by wrapping the sheet around the bellows barrel part with the rear surface thereof in contact with the bellows barrel part.

3. The extendable container according to claim 2, wherein the adhesive is applied in a plurality of bands, on the rear surface of the sheet, extending in the height direction of the sheet or the circular direction of the sheet.

* * * * *